US009636920B2

(12) United States Patent
Matsumoto

(10) Patent No.: US 9,636,920 B2
(45) Date of Patent: May 2, 2017

(54) LIQUID APPLYING APPARATUS AND METHOD FOR MAINTAINING LIQUID APPLYING APPARATUS

(71) Applicant: Tetsuya Matsumoto, Kanagawa (JP)

(72) Inventor: Tetsuya Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/193,443

(22) Filed: Jun. 27, 2016

(65) Prior Publication Data

US 2017/0001445 A1 Jan. 5, 2017

(30) Foreign Application Priority Data

Jul. 1, 2015 (JP) ..... 2015-133127
May 6, 2016 (JP) ..... 2016-093054

(51) Int. Cl.
*B41J 2/195* (2006.01)
*B41J 2/175* (2006.01)

(52) U.S. Cl.
CPC ..... *B41J 2/17566* (2013.01)

(58) Field of Classification Search
CPC ..... B41J 2/17566; B41J 2/195
See application file for complete search history.

(56) References Cited

U.S. PATENT DOCUMENTS 7,537,661 B2 5/2009 Nakagawa et al.
8,696,080 B2 * 4/2014 Cerro ..... B41J 2/175 347/7
8,931,881 B1 1/2015 Sunaoshi
2013/0286061 A1 10/2013 Nakamura
2015/0224775 A1 8/2015 Matsumoto

FOREIGN PATENT DOCUMENTS

| | | |
|---|---|---|
| EP | 1004451 | 5/2000 |
| EP | 2 732 974 | 1/2016 |
| JP | 2007-044647 | 2/2007 |
| JP | 2011-201234 | 10/2011 |
| JP | 2014-100805 | 6/2014 |
| JP | 2015-006766 | 1/2015 |

OTHER PUBLICATIONS

Extended European Search Report dated Nov. 11, 2016.

* cited by examiner

*Primary Examiner* — Juanita D Jackson
(74) *Attorney, Agent, or Firm* — IPUSA, PLLC

(57) ABSTRACT

A liquid applying apparatus includes a feeding container; first and second liquid-supply containers for supplying a liquid to the feeding container; a switch for switching a supply source between the first and second liquid-supply containers; a first storage for storing a supply start time of a supply operation; a second storage for storing supply information including a supply source or a supply route; a third storage for storing a liquid level in the feeding container at the supply start time; a fourth storage for storing a supply operation time of the supply operation; a controller that determines a condition of the liquid applying apparatus based on the supply operation time, and determines the supply source or the supply route as an inspection-required spot based on the supply information when the liquid applying apparatus is in a potentially-abnormal condition; and a fifth storage for storing the inspection-required spot.

12 Claims, 9 Drawing Sheets

FIG.5B

| | 501 | 502 | | 503 | | 504 | | 506 | 505 |
|---|---|---|---|---|---|---|---|---|---|
| | (1) | (2) | (3) | (4) | (5) | (6) | (7) | (8) | (9) |
| OLD DATA 1 | SUPPLY-START DATE AND TIME INFORMATION | SUPPLY DESTINATION INFORMATION | SUPPLY SOURCE INFORMATION | PAN 1 SENSOR INFORMATION | PAN 2 SENSOR INFORMATION | PAN 1 SUPPLY TIME | PAN 2 SUPPLY TIME | FILTER-LIQUID-LEVEL RESTORATION COUNT | INSPECTION-REQUIRED SPOT |
| DATA 2 | SUPPLY-START DATE AND TIME INFORMATION | SUPPLY DESTINATION INFORMATION | SUPPLY SOURCE INFORMATION | PAN 1 SENSOR INFORMATION | PAN 2 SENSOR INFORMATION | PAN 1 SUPPLY TIME | PAN 2 SUPPLY TIME | FILTER-LIQUID-LEVEL RESTORATION COUNT | INSPECTION-REQUIRED SPOT |
| DATA 3 | SUPPLY-START DATE AND TIME INFORMATION | SUPPLY DESTINATION INFORMATION | SUPPLY SOURCE INFORMATION | PAN 1 SENSOR INFORMATION | PAN 2 SENSOR INFORMATION | PAN 1 SUPPLY TIME | PAN 2 SUPPLY TIME | FILTER-LIQUID-LEVEL RESTORATION COUNT | INSPECTION-REQUIRED SPOT |
| DATA 4 | SUPPLY-START DATE AND TIME INFORMATION | SUPPLY DESTINATION INFORMATION | SUPPLY SOURCE INFORMATION | PAN 1 SENSOR INFORMATION | PAN 2 SENSOR INFORMATION | PAN 1 SUPPLY TIME | PAN 2 SUPPLY TIME | FILTER-LIQUID-LEVEL RESTORATION COUNT | INSPECTION-REQUIRED SPOT |
| DATA 5 | SUPPLY-START DATE AND TIME INFORMATION | SUPPLY DESTINATION INFORMATION | SUPPLY SOURCE INFORMATION | PAN 1 SENSOR INFORMATION | PAN 2 SENSOR INFORMATION | PAN 1 SUPPLY TIME | PAN 2 SUPPLY TIME | FILTER-LIQUID-LEVEL RESTORATION COUNT | INSPECTION-REQUIRED SPOT |
| DATA 6 NEW | SUPPLY-START DATE AND TIME INFORMATION | SUPPLY DESTINATION INFORMATION | SUPPLY SOURCE INFORMATION | PAN 1 SENSOR INFORMATION | PAN 2 SENSOR INFORMATION | PAN 1 SUPPLY TIME | PAN 2 SUPPLY TIME | FILTER-LIQUID-LEVEL RESTORATION COUNT | INSPECTION-REQUIRED SPOT |

⋮

FIG.5C

| | 507 | 508 | 509 | | 510 | | 511 |
|---|---|---|---|---|---|---|---|
| | (1) | (2) | (3) | (4) | (5) | (6) | (7) |
| OLD DATA 1 | DISCHARGE-START DATE AND TIME INFORMATION | DISCHARGE SOURCE INFORMATION | PAN 1 SENSOR INFORMATION | PAN 2 SENSOR INFORMATION | PAN 1 DISCHARGE TIME | PAN 2 DISCHARGE TIME | INSPECTION-REQUIRED SPOT |
| DATA 2 | DISCHARGE-START DATE AND TIME INFORMATION | DISCHARGE SOURCE INFORMATION | PAN 1 SENSOR INFORMATION | PAN 2 SENSOR INFORMATION | PAN 1 DISCHARGE TIME | PAN 2 DISCHARGE TIME | INSPECTION-REQUIRED SPOT |
| DATA 3 | DISCHARGE-START DATE AND TIME INFORMATION | DISCHARGE SOURCE INFORMATION | PAN 1 SENSOR INFORMATION | PAN 2 SENSOR INFORMATION | PAN 1 DISCHARGE TIME | PAN 2 DISCHARGE TIME | INSPECTION-REQUIRED SPOT |
| DATA 4 | DISCHARGE-START DATE AND TIME INFORMATION | DISCHARGE SOURCE INFORMATION | PAN 1 SENSOR INFORMATION | PAN 2 SENSOR INFORMATION | PAN 1 DISCHARGE TIME | PAN 2 DISCHARGE TIME | INSPECTION-REQUIRED SPOT |
| DATA 5 | DISCHARGE-START DATE AND TIME INFORMATION | DISCHARGE SOURCE INFORMATION | PAN 1 SENSOR INFORMATION | PAN 2 SENSOR INFORMATION | PAN 1 DISCHARGE TIME | PAN 2 DISCHARGE TIME | INSPECTION-REQUIRED SPOT |
| DATA 6 NEW | DISCHARGE-START DATE AND TIME INFORMATION | DISCHARGE SOURCE INFORMATION | PAN 1 SENSOR INFORMATION | PAN 2 SENSOR INFORMATION | PAN 1 DISCHARGE TIME | PAN 2 DISCHARGE TIME | INSPECTION-REQUIRED SPOT |

⋮

LIQUID APPLYING APPARATUS AND METHOD FOR MAINTAINING LIQUID APPLYING APPARATUS

CROSS-REFERENCE TO RELATED APPLICATIONS

The present application claims priority under 35 U.S.C. §119 to Japanese Patent Application No. 2015-133127, filed on Jul. 1, 2015 and Japanese Patent Application No. 2016-093054, filed on May 6, 2016. The contents of which are incorporated herein by reference in their entirety.

BACKGROUND OF THE INVENTION

1. Field of the Invention

The present disclosure relates to liquid applying apparatuses and methods for maintaining the liquid applying apparatuses.

2. Description of the Related Art

In the field of inkjet recording apparatuses such as printers, it is known to pretreat (or pre-coat) a recording medium with a liquid for coagulating a color material of ink in order to prevent image errors such as bleeding, variations in density and color tones, and show-through and to improve print quality. In a known pre-coating method, a coating liquid contained in a feeding pan is applied to the entire surface of a recording medium by a roller of a coating-liquid applying apparatus.

Generally, such a coating-liquid applying apparatus is regularly inspected by a service person at a frequency of, for example, two times per month. Also, an operator does not generally cause the coating-liquid applying apparatus to execute jobs during the regular inspection by the service person.

In the related-art technology, when the liquid level of a feeding pan of a coating-liquid applying apparatus does not rise or fall even after a predetermined period of time from the start of a supply operation or a discharge operation, it is assumed that the coating-liquid applying apparatus has failed and a time-out error is reported. In response to the time-out error, an operator calls a service person to repair the coating-liquid applying apparatus separately from the regular inspection (see, for example, Japanese Unexamined Patent Application Publication No. 2007-044647 and Japanese Unexamined Patent Application Publication No. 2011-201234).

SUMMARY OF THE INVENTION

According to one aspect of the present invention, a liquid applying apparatus includes at least one application unit including a feeding container configured to contain a liquid, the application unit being configured to apply the liquid to an object; a first liquid-supply container configured to supply the liquid to the feeding container; a second liquid-supply container configured to supply the liquid to the feeding container; a switch configured to switch a supply source of the liquid between the first liquid-supply container and the second liquid-supply container; a first storage configured to store a supply start time when a supply operation to supply the liquid to the feeding container is started, the supply operation being performed to fill the feeding container with the liquid up to a predetermined supply level; a second storage configured to store supply information including one of supply source information indicating the supply source of the liquid and supply route information indicating a supply route through which the liquid is supplied; a third storage configured to store a liquid level of the liquid in the feeding container at a start of the supply operation; a fourth storage configured to store a supply operation time from the start of the supply operation until the liquid in the feeding container reaches the predetermined supply level; a controller configured to determine, after the supply operation is completed, a condition of the liquid applying apparatus based on the supply operation time stored in the fourth storage as one of a normal condition, an abnormal condition requiring a repair, and a potentially-abnormal condition that is different from both of the normal condition and the abnormal condition, and determine the supply source or the supply route as an inspection-required spot based on the supply information stored in the second storage when the liquid applying apparatus is determined to be in the potentially-abnormal condition; and a fifth storage configured to store the inspection-required spot determined by the controller.

BRIEF DESCRIPTION OF THE DRAWINGS

FIG. 5B is a table illustrating an exemplary supply log stored in a non-volatile memory;

FIG. 5C is a table illustrating an exemplary discharge log stored in a non-volatile memory;

DESCRIPTION OF THE EMBODIMENTS

Embodiments of the present invention are described below with reference to the accompanying drawings.

Figure 1A:
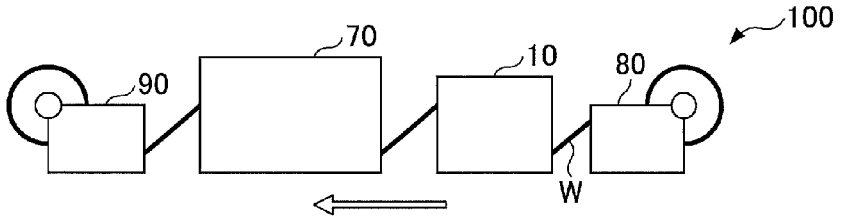
FIG. 1A is a schematic diagram illustrating a system including a coating-liquid applying apparatus according to an embodiment of the present invention.

FIG. 1A is a schematic diagram illustrating a system 100 including a coating-liquid applying apparatus 10 according to an embodiment of the present invention. The coating-liquid applying apparatus 10 is coupled between a paper feeder 80 and an inkjet printer 70.

The paper feeder 80 feeds rolled paper W into the coating-liquid applying apparatus (liquid applying apparatus) 10.

The coating-liquid applying apparatus 10 applies a liquid (which may also be referred to as a "coating liquid", a "pre-treatment liquid", or a "pre-coating liquid") to an image-forming surface(s) of the paper W (which may also be referred to as a "recording medium" or an "object"). The coating liquid is made of a coating material having a function to coagulate ink droplets jetted onto the paper W.

The inkjet printer 70 performs printing on the paper W to which the coating liquid has been applied by the coating-liquid applying apparatus 10. The inkjet printer 70 jets ink droplets onto the front side and the back side of the paper W to form images.

After the printing, the paper W is fed into a post-processing apparatus 90 that performs predetermined post-processing on the paper W. In the example of FIG. 1A, after the post-processing, the paper W is wound by a winding roller into a roll.

Figure 1B:
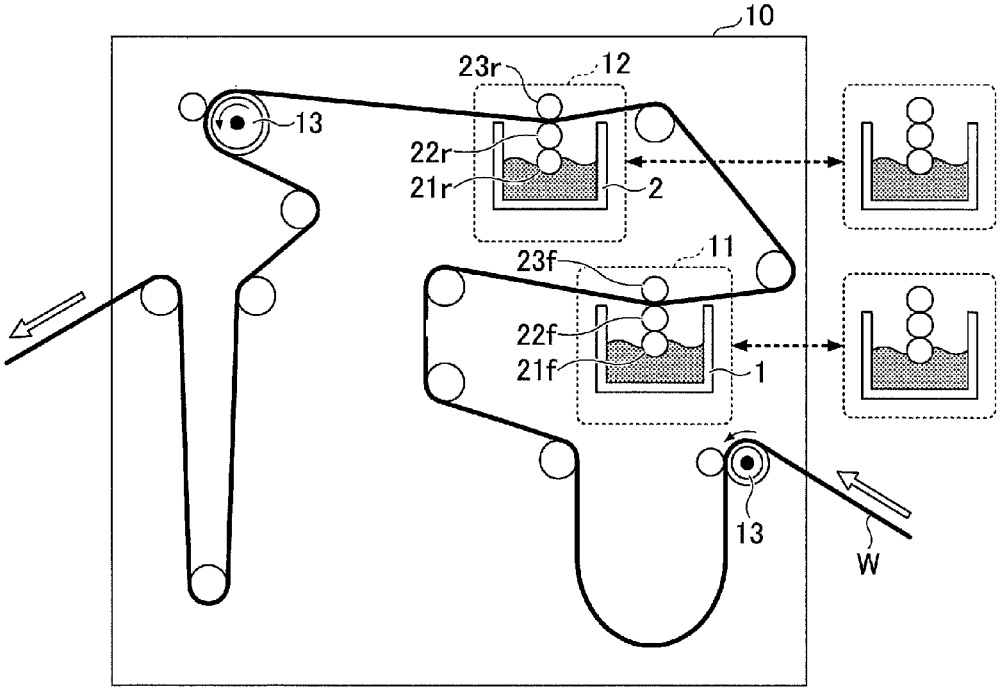
FIG. 1B is a schematic diagram illustrating an exemplary configuration of the coating-liquid applying apparatus of the system of FIG. 1A.

FIG. 1B is a schematic diagram illustrating an exemplary configuration of the coating-liquid applying apparatus 10 according to an embodiment.

The coating-liquid applying apparatus 10 may include conveyors 13 for conveying the paper W, a front-side application unit 11 for applying the coating liquid to the front side of the paper W, a back-side application unit 12 for applying the coating liquid to the back side of the paper W, and a coating-liquid supplying apparatus for supplying the coating liquid to the front-side application unit 11 and the back-side application unit 12.

The conveyors 13 convey the paper W, which is fed by the paper feeder 80 into the coating-liquid applying apparatus 10, in a predetermined direction along a conveying path.

The front-side application unit 11 is disposed in the conveying path and applies the coating liquid to the front side of the paper W.

The front-side application unit 11 includes a cylindrical application roller 22*f*, a squeeze roller 21*f* that is in contact with the coating liquid in a feeding pan 1 and transfers a thin film of the coating liquid onto the application roller 22*f*, and a pressure roller 23*f* that presses the paper W sandwiched between the application roller 22*f* and the pressure roller 23*f*.

The back-side application unit 12 is also disposed in the conveying path. After the coating liquid is applied to the front side of the paper W by the front-side application unit 11, the back-side application unit 12 applies the coating liquid onto the back side of the paper W. The back-side application unit 12 has substantially the same configuration as the configuration of the front-side application unit 11, and includes an application roller 22*r*, a squeeze roller 21*r*, and a pressure roller 23*r*.

Each of the front-side application unit 11 and the back-side application unit 12 is removable from the coating-liquid applying apparatus 10, and can be replaced with an application unit that is, for example, suitable for the type of printing paper.

Although omitted in FIG. 1B, the coating-liquid applying apparatus 10 may also include an air-loop unit, a heater, and a dancer unit.

Next, the coating-liquid supplying apparatus 20 is described with reference to FIGS. 2 and 3.

Figure 2:
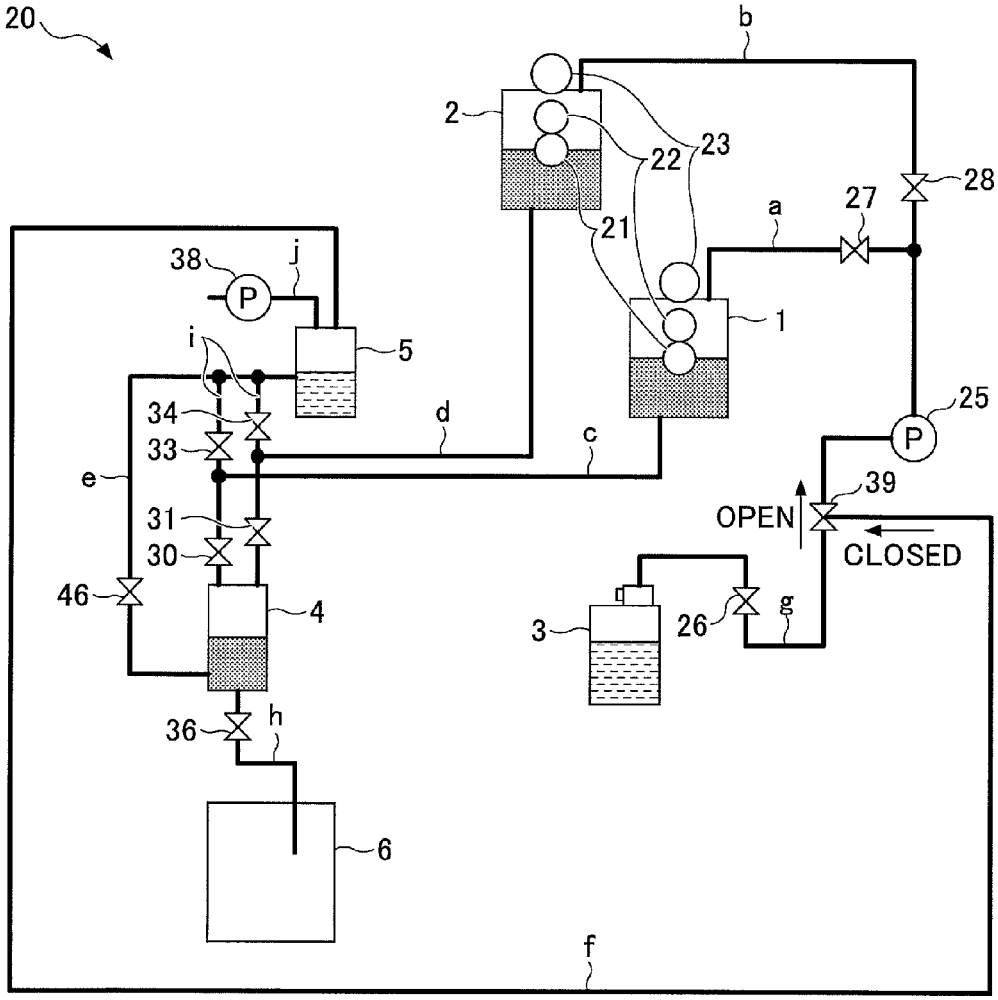
FIG. 2 is a schematic diagram illustrating an exemplary configuration of a coating-liquid supplying apparatus in the coating-liquid applying apparatus of FIG. 1B.

FIG. 2 is a schematic diagram illustrating an exemplary configuration of the coating-liquid supplying apparatus 20 in the coating-liquid applying apparatus 10 of FIG. 1B.

The coating-liquid supplying apparatus 20 includes a front-side feeding pan (front-side feeding container) 1 that is a reservoir for containing the coating liquid to be applied to the front side of the paper W, a back-side feeding pan (back-side feeding container) 2 that is a reservoir for containing the coating liquid to be applied to the back side of the paper W, a cartridge 3, a reserve tank 4, a filter case 5, and a waste tank (recovery container) 6.

The feeding pan 1 is disposed in the front-side application unit 11 and contains the coating liquid below the squeeze roller 21*f*. The feeding pan 2 is disposed in the back-side application unit 12 and contains the coating liquid below the squeeze roller 21*r*. The feeding pans 1 and 2, respectively, supply the coating liquid via the squeeze rollers 21*f* and 21*r* to the application rollers 22*f* and 22*r* that apply the coating liquid to the paper W (object) in the application units 11 and 12.

The cartridge 3 is a first liquid-supply container that contains unused coating liquid to be supplied to the feeding pans 1 and 2.

The reserve tank 4 is a second liquid-supply container that temporarily retains (or reserves) the coating liquid.

The feeding pan 1 is formed to cover at least the squeeze roller 21*f*, and preferably to also cover the application roller 22*f*. The feeding pan 2 is formed to cover at least the squeeze roller 21*r*, and preferably to also cover the application roller 22*r*. The feeding pans 1 and 2 are so shaped that evaporation of the contained coating liquid and degradation of the coating liquid due to exposure to air can be reduced. However, because the feeding pans 1 and 2 need to have openings at positions where the pressure rollers 23*f* and 23*r* are pressed against the corresponding application rollers 22*f* and 22*r*, the feeding pans 1 and 2 are not completely closed.

For the above reason, the reserve tank 4, which is more airtight than the feeding pans 1 and 2, is provided.

The filter case (filter container) 5 contains a filter for removing foreign matter from the coating liquid being circulated from the feeding pans 1 and 2 through the filter case 5 during an application operation.

The coating-liquid supplying apparatus 20 includes a three-way solenoid valve 39 as a switch, and multiple solenoid valves 26, 27, 28, 30, 31, 33, 34, 36, and 46 as flow-path opening-closing devices.

The coating-liquid supplying apparatus 20 also includes pumps 25 and 38 as flow generators for causing the coating liquid to flow. The pumps 25 and 38 may be implemented by, for example, tubing pumps or diaphragm pumps.

Figure 3:
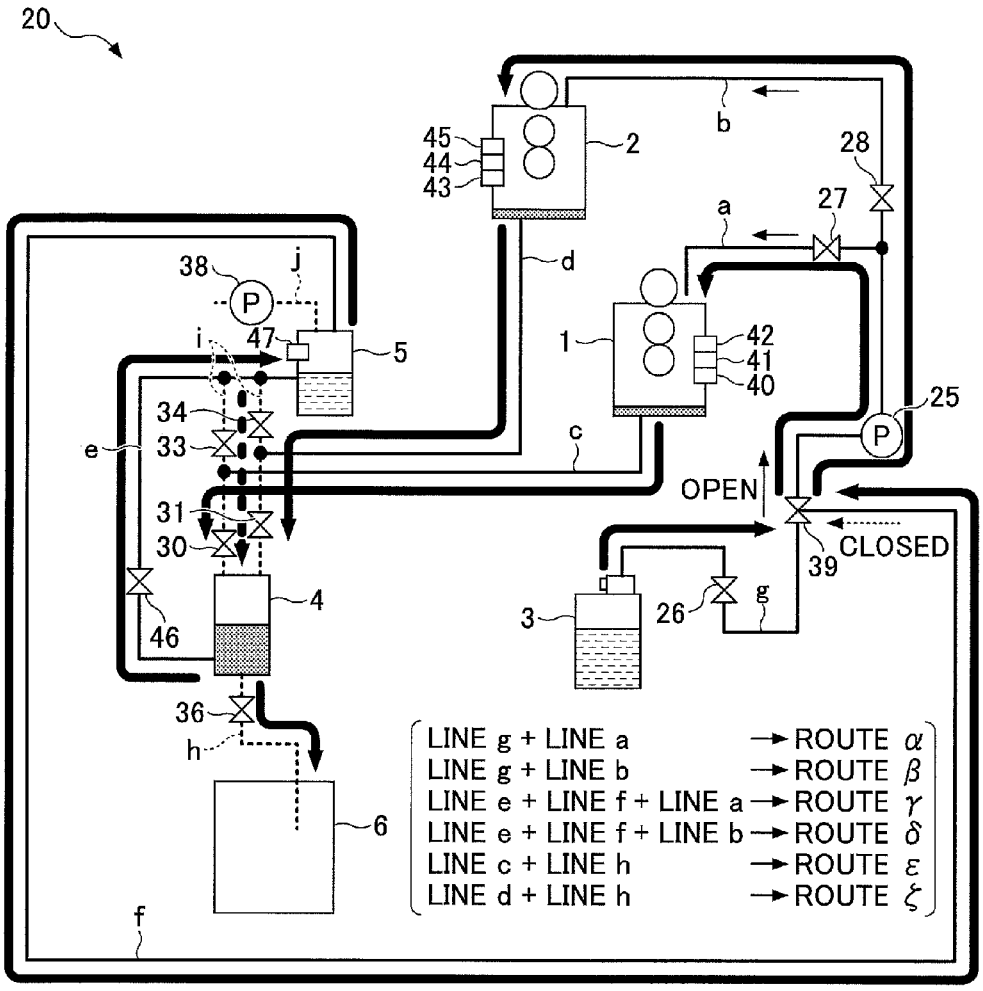
FIG. 3 is a drawing illustrating the flow of a coating liquid during a supply operation and a discharge operation of the coating-liquid supplying apparatus of FIG. 2.

FIG. 3 is a drawing illustrating the flow of the coating liquid during a supply operation and a discharge operation of the coating-liquid supplying apparatus 20 of FIG. 2. In FIG. 3, bold arrows indicate the flow of the coating liquid.

The cartridge 3 supplies unused coating liquid to the feeding pans 1 and 2. The pump 25 causes the coating liquid to flow into the feeding pans 1 and 2. The pump 25 may be implemented by, for example, a tubing pump or a diaphragm pump.

A line (outgoing line) "g" is formed between the cartridge 3 and the pump 25.

A front-side supply line "a" is a flow path of the coating liquid from the pump 25 to the feeding pan 1. A back-side supply line "b" is a flow path of the coating liquid from the pump 25 to the feeding pan 2. The pump 25 causes the coating liquid to flow into the feeding pans 1 and 2.

The solenoid valve 27 opens and closes the flow path (supply line "a") to the feeding pan 1. The solenoid valve 28 opens and closes the flow path (supply line "b") to the feeding pan 2.

A low(L)-level sensor 40, a middle(M)-level sensor 41, and a high(H)-level sensor 42 are disposed in the feeding pan 1. The sensors 40, 41, and 42 may be referred to as "front-side liquid-level detectors (sensors)".

A low(L)-level sensor 43, a middle(M)-level sensor 44, and a high(H)-level sensor 45 are disposed in the feeding pan 2. The sensors 43, 44, and 45 may be referred to as "back-side liquid-level detectors (sensors)". The M-level sensors 41 and 44 may also be referred to as "fixed-level sensors".

A front-side escape line "c" leads from the feeding pan 1 to the reserve tank 4 and the filter case 5. The solenoid valve 30 opens and closes an escape path that is a portion of the front-side escape line "c" leading to the reserve tank 4. The solenoid valve 33 opens and closes a circulation path (leak i) that is a portion of the front-side escape line "c" leading to the filter case 5.

A back-side escape line "d" leads from the feeding pan 2 to the reserve tank 4 and the filter case 5. The solenoid valve 31 opens and closes an escape path that is a portion of the back-side escape line "d" leading to the reserve tank 4. The solenoid valve 34 opens and closes a circulation path (leak i) that is a portion of the back-side escape line "d" leading to the filter case 5.

The paths including the solenoid valves 33 and 34 and coupling the filter case 5 and the reserve tank 4 are referred to as "leaks i".

The feeding pans 1 and 2 are coupled to the reserve tank 4 via lines "i" including the solenoid valves 30 and 31. When the solenoid valves 30 and 31 are opened, the coating liquid in the feeding pans 1 and 2 are discharged into the reserve tank 4 due to the hydraulic head difference.

A circulation line "e" including the solenoid valve 46 is formed to couple the reserve tank 4 to the filter case 5. Also, a circulation line "f" is formed to couple the filter case 5 to the three-way solenoid valve 39 used as a switch.

A filter sensor 47 is disposed in the filter case 5. The filter sensor 47 detects the liquid level in the filter case 5.

A vacuum pump 38 is coupled via a line "j" to the filter case 5. The vacuum pump 38 is used to maintain the coating liquid in the filter case 5 at a constant liquid level.

While the coating liquid is supplied from the reserve tank 4 to the filter case 5, whether the coating liquid in the filter case 5 is at a predetermined liquid level is checked by using, for example, the filter sensor 47. When the liquid level in the filter case 5 becomes higher than or equal to an upper limit, the solenoid valve 46 is closed to limit the supply of the coating liquid into the filter case 5 and thereby lower the liquid level in the filter case 5 (high-level restoration operation).

On the other hand, when the liquid level in the filter case 5 becomes lower than or equal to a lower limit, the solenoid valve 46 is closed and the vacuum pump 38 is driven to reduce the pressure in the filter case 5 to a negative pressure, and then the solenoid valve 46 is opened. As a result, the coating liquid in the reserve tank 4 is forced to flow into the filter case 5 and the liquid level in the filter case 5 is increased (low-level restoration operation).

The three-way solenoid valve 39 is disposed at a junction between the outgoing line "g" and the circulation line "f". When the three-way solenoid valve 39 is opened, the outgoing line "g" coupling the pump 25 to the cartridge 3 is opened. When the three-way solenoid valve 39 is closed, the circulation line "f" coupling the pump 25 to the filter case 5 is opened.

Thus, the three-way solenoid valve 39 always outputs the coating liquid to the supply lines "a" and "b". On the other hand, the three-way solenoid valve 39 switches input lines to receive the coating liquid either from the cartridge 3 or from the reserve tank 4 via the filter case 5.

Also, a path (recovery line) "h" is formed between the reserve tank 4 and the waste tank 6, and the solenoid valve 36 opens and closes the path "h".

An outgoing-supply route (front-side unused-liquid supply route) α (line "g"+line "a") is used to supply the coating liquid from the cartridge 3 via the three-way solenoid valve 39 to the feeding pan 1.

An outgoing-supply route (back-side unused-liquid supply route) β (line "g"+line "b") is used to supply the coating liquid from the cartridge 3 via the three-way solenoid valve 39 to the feeding pan 2.

A circulation-supply route (front-side circulated-liquid supply route) γ (line "e"+line "f"+line "a") is used to supply the coating liquid from the reserve tank 4 via the filter case 5 and the three-way solenoid valve 39 to the feeding pan 1.

A circulation-supply route (back-side circulated-liquid supply route) δ (line "e"+line "f"+line "b") is used to supply the coating liquid from the reserve tank 4 via the filter case 5 and the three-way solenoid valve 39 to the feeding pan 2.

An escape-discharge route (front-side discharge route) ϵ (line "c"+line "h") is used to discharge the coating liquid from the feeding pan 1 via the reserve tank 4 into the waste tank 6.

An escape-discharge route (back-side discharge route) ζ (line "d"+line "h") is used to discharge the coating liquid from the feeding pan 2 via the reserve tank 4 into the waste tank 6.

<Hardware and Functional Configurations>

Figure 4:
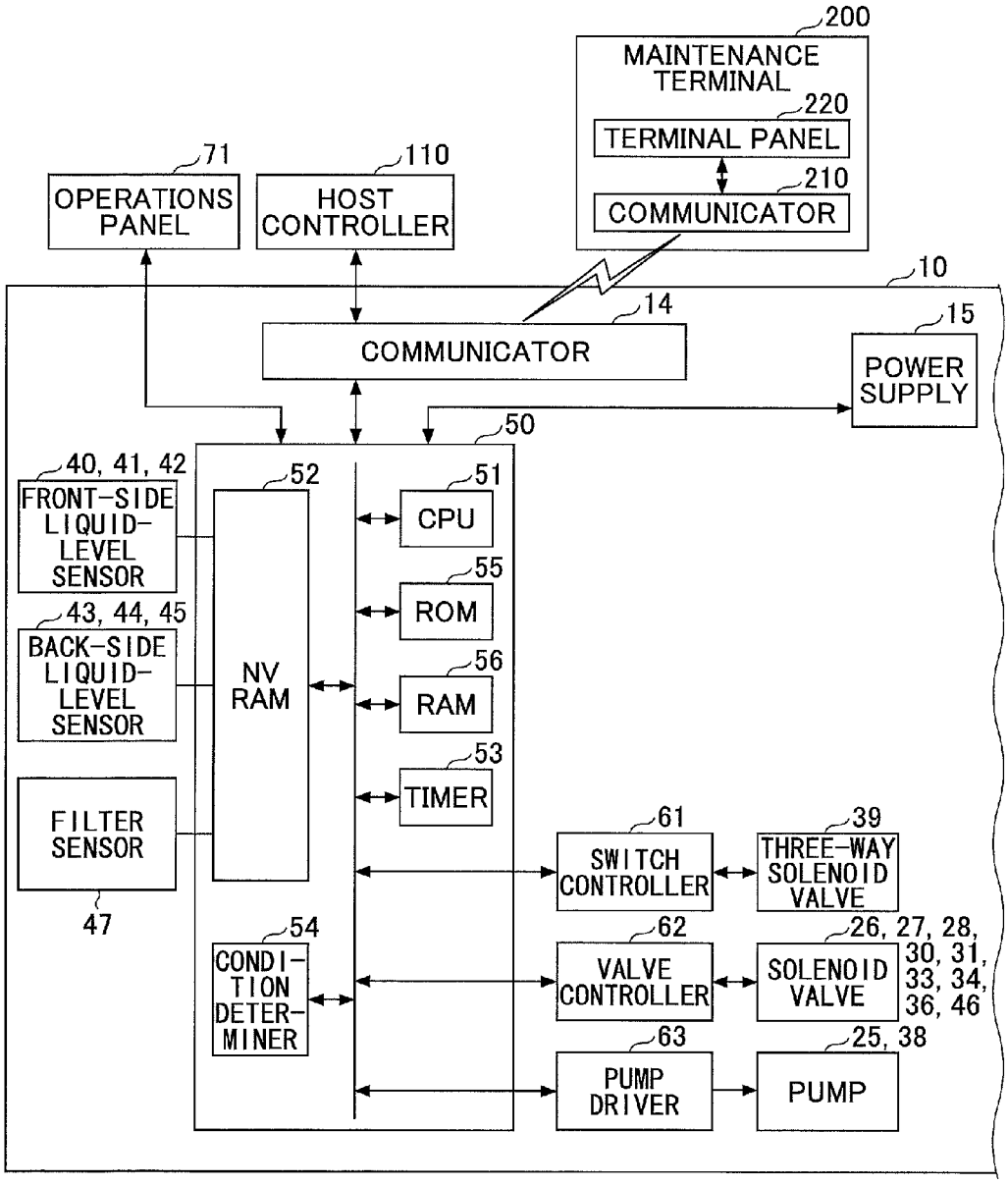
FIG. 4 is a block diagram illustrating exemplary hardware and functional configurations of the coating-liquid applying apparatus of FIG. 1B.

FIG. 4 is a block diagram illustrating exemplary hardware and functional configurations of the coating-liquid applying apparatus 10.

As illustrated by FIG. 4, in addition to the components described above, the coating-liquid applying apparatus 10 may include a controller 50, a switch controller 61, a valve controller 62, a pump driver 63, a power supply 15, and a communicator 14.

The controller 50 of the coating-liquid applying apparatus 10 is coupled via the communicator 14 to a host controller (higher-level apparatus) 110.

The controller 50 may also be coupled to an operations panel 71 disposed on the coating-liquid applying apparatus 10. Alternatively, the operations panel 71 may be disposed on the inkjet printer 70 illustrated in FIG. 1A.

During an inspection, the communicator 14 of the coating-liquid applying apparatus 10 may be configured to communicate with a maintenance terminal 200 that is operated by a service person (e.g., a customer engineer).

The maintenance terminal 200 includes a communicator 210 and a terminal panel 220.

The controller 50 may include a central processing unit (CPU) 51, a non-volatile random access memory (NVRAM) 52, a timer 53, a condition determiner 54, a read-only memory (ROM) 55, and a RAM 56.

A supply operation for supplying the coating liquid to the feeding pan 1 and the feeding pan 2 is performed when, for example, a switch on the operations panel 71 is pressed by an operator or a command is received from the host controller 110 coupled to the coating-liquid applying apparatus 10 before the conveyance of the paper W is started.

A discharge operation for discharging the coating liquid (pre-coating liquid) from the feeding pan and the feeding pan 2 is performed to prevent degradation of the coating liquid while the application operation of the coating-liquid applying apparatus 10 is stopped for a period of time longer than the normal interval between jobs due to, for example, replacement of the paper W or a change in a printing pattern. Also, the discharge operation may be performed to prevent degradation of the coating liquid when the front-side application unit 11 and the back-side application unit 12 are removed from the coating-liquid applying apparatus 10 to replace them.

The controller 50 determines the condition or state of the coating-liquid applying apparatus 10, and performs the supply operation or the discharge operation.

The CPU 51 of the controller 50 receives supply necessity information and/or discharge necessity information from the operations panel 71 or the host controller 110. The supply necessity information indicates whether it is necessary to perform the supply operation, and the discharge necessity information indicates whether it is necessary to perform the discharge operation. The CPU 51 also receives information indicating whether the supply operation or the discharge operation is performed for the front-side feeding pan 1, for the back-side feeding pan 2, or for both of the front-side feeding pan 1 and the back-side feeding pan 2.

The controller 50 is coupled to the power supply 15.

Based on the determined condition, the CPU 51 determines whether to supply the coating liquid from the cartridge 3 or the reserve tank 4, and determines a route(s) used for supplying the coating liquid.

Alternatively, the CPU 51 may receive information indicating a route(s) for supplying the coating liquid from the host controller 110 or an operator via the operations panel 71.

The CPU 51 controls the driving of the switch controller 61, the valve controller 62, and the pump driver 63 and thereby controls the three-way solenoid valve 39, the solenoid valves 26, 27, 28, 30, 31, 33, 34, 36, and 46, and the pumps 25 and 38 so that the coating liquid is supplied via appropriate routes to the feeding pans 1 and 2.

The timer 53 measures a supply operation time taken to supply the coating liquid to the feeding pan 1 and a supply operation time taken to supply the coating liquid to the feeding pan 2.

More specifically, when a supply operation for the feeding pan 1 is completed, the timer 53 calculates a supply operation time for the feeding pan 1 based on a difference between supply-completion date-and-time information indicating when the supply operation is completed and supply-start date-and-time information ((1) in FIG. 5B) indicating when the supply operation is started. Similarly, when a supply operation for the feeding pan 2 is completed, the timer 53 calculates a supply operation time for the feeding pan 2 based on a difference between supply-completion date-and-time information indicating when the supply operation is completed and supply-start date-and-time information indicating ((1) in FIG. 5B) when the supply operation is started. The supply operation time calculated for each of the feeding pans 1 and 2 is stored in the NVRAM 52 as a log.

The supply operation is completed when the liquid level in each of the feeding pans 1 and 2 rises up to a predetermined level (a liquid level detected by the H-level sensor 42 or 45).

The timer 53 also measures a discharge operation time taken to discharge the coating liquid from the feeding pan 1 and a discharge operation time taken to discharge the coating liquid from the feeding pan 2.

More specifically, when a discharge operation for the feeding pan 1 is completed, the timer 53 calculates a discharge operation time for the feeding pan based on a difference between discharge-completion date-and-time information indicating when the discharge operation is completed and discharge-start date-and-time information ((1) in FIG. 5C) indicating when the discharge operation is started. Similarly, when a discharge operation for the feeding pan 2 is completed, the timer 53 calculates a discharge operation time for the feeding pan 2 based on a difference between discharge-completion date-and-time information indicating when the discharge operation is completed and discharge-start date-and-time information ((1) in FIG. 5C) indicating when the discharge operation is started. The discharge operation time calculated for each of the feeding pans 1 and 2 is stored in the NVRAM 52 as a log.

The discharge operation is completed when the liquid level in each of the feeding pans 1 and 2 falls to a predetermined level (a liquid level undetectable by the L-level sensor 40 or 43).

The front-side liquid-level sensors 40, 41, and 42 and the back-side liquid-level sensors 43, 44, and 45 are coupled via, for example, an interface to the NVRAM 52.

The NVRAM 52 stores the following information items (supply log) during a supply operation (see FIG. 5B):

(1) Supply-start date-and-time information indicating when a trigger to start the supply operation is detected.

(2) Supply destination information indicating one or more destinations (front-side feeding pan 1, back-side feeding pan 2, or both) to which the coating liquid is supplied.

(3) Supply source information indicating a source (cartridge 3 or reserve tank 4) from which the coating liquid is supplied, and/or a route(s) through which the coating liquid is supplied from the source to the destination(s).

(4) Pan 1 sensor information indicating the liquid level in the feeding pan 1 detected by the front-side liquid-level sensors 40, 41, and 42 at the start of the supply operation.

(5) Pan 2 sensor information indicating the liquid level in the feeding pan 2 detected by the back-side liquid-level sensors 43, 44, and 45 at the start of the supply operation.

(6) Pan 1 supply time indicating a supply operation time taken to supply the coating liquid to the feeding pan 1.

(7) Pan 2 supply time indicating a supply operation time taken to supply the coating liquid to the feeding pan 2.

(8) Filter-liquid-level restoration count including a high-level restoration count indicating the number of times the high-level restoration operation is performed and a low-level restoration count indicating the number of times the low-level restoration operation is performed, for the filter case 5 during the supply operation.

(9) Inspection required spot indicating a route (supply route) or a path that needs to be inspected by a service person. The inspection required spot may be determined after the supply operation is completed for each feeding pan based on, for example, the supply operation time and/or the filter-liquid-level restoration count.

When the source of the coating liquid is changed during the supply operation, the above information items are stored into the NVRAM 52 again from the first information item (1).

The NVRAM 52 stores the following information items (discharge log) during a discharge operation (see FIG. 5C):

(1) Discharge-start date-and-time information indicating when a trigger to start the discharge operation is detected.

(2) Discharge source information indicating one or more sources (front-side feeding pan 1, back-side feeding pan 2, or both) from which the coating liquid is discharged.

(3) Pan 1 sensor information indicating the liquid level in the feeding pan 1 detected by the front-side liquid-level sensors 40, 41, and 42 at the start of the discharge operation.

(4) Pan 2 sensor information indicating the liquid level in the feeding pan 2 detected by the back-side liquid-level sensors 43, 44, and 45 at the start of the discharge operation.

(5) Pan 1 discharge time indicating a discharge operation time taken to discharge the coating liquid from the feeding pan 1.

(6) Pan 2 discharge time indicating a discharge operation time taken to discharge the coating liquid from the feeding pan 2.

(7) Inspection required spot indicating a route (discharge route) or a path that needs to be inspected by a service person. The inspection required spot may be determined after the discharge operation is completed for each feeding pan based on, for example, the discharge operation time.

Figure 5A:
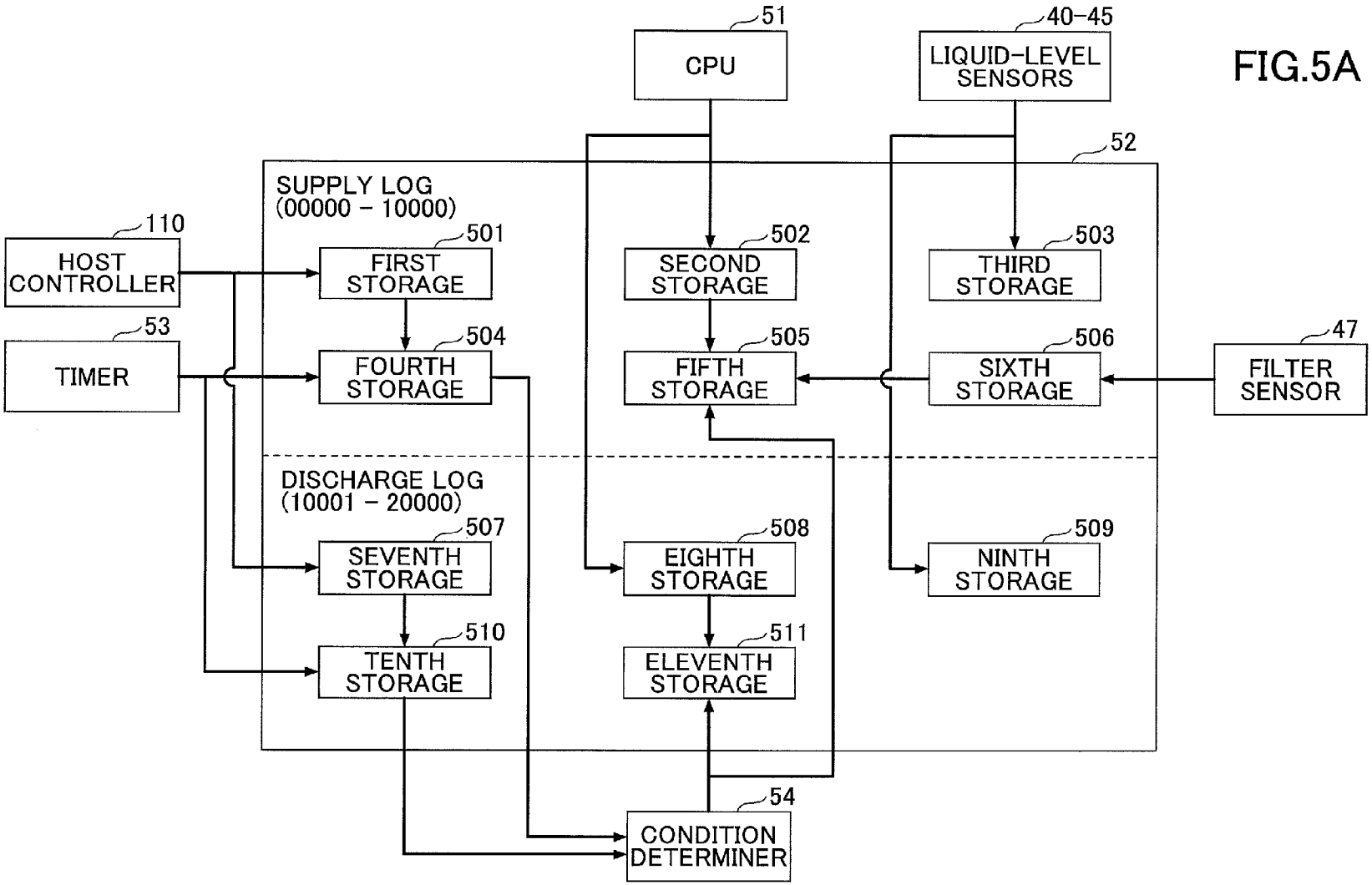
FIG. 5A is a drawing illustrating exemplary memory allocation of a non-volatile memory.

The above information items (the supply log and the discharge log) are stored in the NVRAM 52 as illustrated by FIGS. 5A through 5C.

An example of the trigger (see "(1) Supply-start date-and-time information" described above) to start a supply operation to supply the coating liquid to the feeding pans 1 and 2 is an event where an operator presses a switch on the operations panel 71 to cause the coating-liquid applying apparatus 10 to transition to an application-ready state. Another example of the trigger to start a supply operation is an event where the coating-liquid applying apparatus 10 detects the reception of a command sent from the host controller 110 before the conveyance of the paper W is started.

An example of the trigger (see "(1) Discharge-start date-and-time information" described above) to start a discharge operation is an event where the application operation of the coating-liquid applying apparatus 10 is stopped for a period of time longer than the normal interval between jobs due to, for example, replacement of the paper W or a change in a printing pattern. Another example of the trigger to start a discharge operation is an event where the front-side application unit 11 and the back-side application unit 12 are removed from the coating-liquid applying apparatus 10 to replace them. In either case, a discharge operation is performed to prevent degradation of the coating liquid.

The supply log and the discharge log are stored at predetermined addresses in the NVRAM 52.

FIG. 5A is a drawing illustrating exemplary memory allocation of the NVRAM 52, FIG. 5B is a table illustrating an exemplary supply log stored in the NVRAM 52, and FIG. 5C is a table illustrating an exemplary discharge log stored in the NVRAM 52.

As illustrated in FIG. 5A, separate log areas for the supply log and the discharge log are defined in the NVRAM 52.

Referring to FIGS. 5A and 5B, a supply log area for the supply log in the NVRAM 52 includes a first storage 501, a second storage 502, a third storage 503, a fourth storage 504, a fifth storage 505, and a sixth storage 506.

The first storage 501 stores supply-start date-and-time information ((1) in FIG. 5B) indicating when a supply operation to supply the coating liquid to the feeding pans 1 and 2 is started. In the supply operation, the feeding pans 1 and 2 are filled with the coating liquid up to a predetermined liquid level.

The second storage 502 stores supply destination information ((2) in FIG. 5B) indicating destinations, i.e., the feeding pans 1 and 2, to which the coating liquid is supplied; and supply source information ((3) in FIG. 5B) indicating a source, i.e., the cartridge 3 or the reserve tank 4, from which the coating liquid is supplied and/or supply routes through which the coating liquid is supplied from the source to the destinations.

The third storage 503 stores pan 1 sensor information ((4) in FIG. 5B) indicating a liquid level (L, M, H) in the feeding pan 1 detected by the front-side liquid-level sensors 40, 41, and 42 at the start of the supply operation, and pan 2 sensor information ((5) in FIG. 5B) indicating a liquid level (L, M, H) in the feeding pan 2 detected by the back-side liquid-level sensors 43, 44, and 45 at the start of the supply operation.

The fourth storage 504 stores pan 1 supply time ((6) in FIG. 5B) indicating a supply operation time taken to supply the coating liquid to the feeding pan 1, and pan 2 supply time ((7) in FIG. 5B) indicating a supply operation time taken to supply the coating liquid to the feeding pan 2.

The fifth storage 505 stores an inspection-required spot ((9) in FIG. 5B). When it is determined that the coating-liquid applying apparatus 10 is in a potentially-abnormal condition, the condition determiner 54 determines an inspection-required spot based on supply information (supply destination information, supply source information, and supply routes) stored in the second storage 502.

The sixth storage 506 stores the filter-liquid-level restoration count ((8) in FIG. 5B) including the high-level restoration count indicating the number of times the high-level restoration operation is performed and the low-level restoration count indicating the number of times the low-level restoration operation is performed.

The condition determiner 54 may be configured to determine the condition of the coating-liquid applying apparatus 10 taking into account the filter-liquid-level restoration count in addition to the supply operation time.

Referring to FIGS. 5A and 5C, a discharge log area for the discharge log in the NVRAM 52 includes a seventh storage 507, an eighth storage 508, a ninth storage 509, a tenth storage 510, and an eleventh storage 511.

The seventh storage 507 stores discharge-start date-and-time information ((1) in FIG. 5C) indicating when a discharge operation to discharge the coating liquid from the feeding pans 1 and 2 is started. In the discharge operation, the coating liquid is discharged until the liquid level in each of the feeding pans 1 and 2 decreases to a predetermined liquid level.

The eighth storage 508 stores discharge source information ((2) in FIG. 5C) indicating one or both of the feeding pans 1 and 2 from which the coating liquid is discharged, or discharge routes through which the coating liquid is discharged.

The ninth storage 509 stores pan 1 sensor information ((3) in FIG. 5C) indicating a liquid level (L, M, H) in the feeding pan 1 detected by the front-side liquid-level sensors 40, 41, and 42 at the start of the discharge operation, and pan 2 sensor information ((4) in FIG. 5C) indicating a liquid level (L, M, H) in the feeding pan 2 detected by the back-side liquid-level sensors 43, 44, and 45 at the start of the discharge operation.

The tenth storage 510 stores pan 1 discharge time ((5) in FIG. 5C) indicating a discharge operation time taken to discharge the coating liquid until the liquid level in the feeding pan 1 decreases to a predetermined level, and pan 2 discharge time ((6) in FIG. 5C) indicating a discharge operation time taken to discharge the coating liquid until the liquid level in the feeding pan 2 decreases to a predetermined level.

The eleventh storage 511 stores an inspection-required spot ((7) in FIG. 5C). When it is determined that the coating-liquid applying apparatus 10 is in a potentially-abnormal condition, the condition determiner determines a discharge route(s) through which the coating liquid is discharged as the inspection-required spot.

The coating-liquid applying apparatus 10 is configured to be regularly inspected. In addition, when the condition determiner 54 determines that the coating-liquid applying apparatus 10 is in an abnormal condition, the coating-liquid applying apparatus 10 (or the controller 50) determines that a repair is necessary and reports a timeout error to request (or call) a service person to perform an irregular inspection.

When performing a regular inspection or an irregular inspection, the service person refers to the supply log and the discharge log as illustrated by FIGS. 5B and 5C.

As illustrated in FIG. 5A, separate log areas for the supply log and the discharge log are defined in the NVRAM 52 so that the service person can easily refer to the supply log and the discharge log.

As illustrated by FIGS. 5B and 5C, the log areas preferably store logs of all supply operations and all discharge operations performed during a period between the previous inspection and the current inspection. That is, the coating-liquid applying apparatus 10 is preferably configured to report, to the service person, stored information on all supply operations and all discharge operations performed during a period between the previous inspection and the current inspection.

When at least one of the L-level sensor 40, the M-level sensor 41, and the H-level sensor 42 in the feeding pan 1 cannot detect the coating liquid even after a predetermined time T2 from the start of a supply operation, the coating-liquid applying apparatus 10 (or the controller 50) reports a supply timeout error.

Similarly, when at least one of the L-level sensor 43, the M-level sensor 44, and the H-level sensor 45 in the feeding pan 2 cannot detect the coating liquid even after a predetermined time T3 from the start of a supply operation, the coating-liquid applying apparatus 10 (or the controller 50) reports a supply timeout error.

When the supply timeout error is reported, the operator calls a service person to repair the coating-liquid applying apparatus 10.

For example, the service person uses an adjustment routine provided in the coating-liquid applying apparatus 10 to determine a cause of the coating liquid being not normally supplied to the feeding pan 1 and/or the feeding pan 2, and repairs the coating-liquid applying apparatus 10 by, for example, replacing a component or cleaning the coating-liquid applying apparatus 10.

The predetermined time T2 and the predetermined time T3 may be set at a value that is, for example, 1.5 times greater than the normal supply operation time so that a malfunction in the coating-liquid applying apparatus 10 can be clearly identified.

Examples of causes of the supply timeout error may include clogging of one or more of the front-side unused-liquid supply route α (line "g"+line "a"), the back-side unused-liquid supply route β (line "g"+line "b"), the front-side circulated-liquid supply route γ (line "e"+line "f"+line "a"), and the back-side circulated-liquid supply route δ (line "e"+line "f"+line "b") due to paper dust; leakage of the coating liquid at a joint between tubes constituting a route; leakage or clogging of the filter case 5; abnormal output of the pumps 25 and 38; and a failure of one or more of the three-way solenoid valve 39 and the relevant solenoid valves.

Similarly, when the L-level sensor 40 in the feeding pan 1 and/or the L-level sensor 43 in the feeding pan 2 still detects the coating liquid even after a predetermined time T4 from the start of a discharge operation, the coating-liquid applying apparatus 10 (or the controller 50) reports a discharge timeout error.

When the discharge timeout error is reported, the operator calls a service person to repair the coating-liquid applying apparatus 10 separately from the regular inspection. For example, the service person uses an adjustment routine provided in the coating-liquid applying apparatus 10 to determine a cause of the coating liquid being not normally discharged from the feeding pan and/or the feeding pan 2, and repairs the coating-liquid applying apparatus 10 by, for example, replacing a component or cleaning the coating-liquid applying apparatus 10.

The predetermined time T4 may be set at a value that is, for example, 1.5 times greater than the normal discharge operation time so that a malfunction in the coating-liquid applying apparatus 10 can be clearly identified.

Examples of causes of the discharge timeout error may include clogging of the front-side discharge route ϵ (line "c"+line "h") and/or the back-side discharge route ζ (line "d"+line "h") due to paper dust, and a failure of one or more of the relevant solenoid valves.

As described above, when a supply operation or a discharge operation cannot be normally performed due to a malfunction in the coating-liquid applying apparatus 10 (or the coating-liquid supplying apparatus 20), the coating-liquid applying apparatus 10 (or the controller 50) reports a timeout error. When the timeout error is reported, the operator calls a service person to repair the coating-liquid applying apparatus 10 separately from a regular inspection. While the coating-liquid applying apparatus 10 is being repaired, i.e., during the downtime of the coating-liquid applying apparatus 10, the operator cannot use the coating-liquid applying apparatus 10 for a long period of time.

In the present embodiment, based on a measured supply operation time, the condition determiner 54 determines the condition of the coating-liquid applying apparatus 10 as one of a normal condition, an abnormal condition where it is necessary to report a timeout error and call a service person to repair the coating-liquid applying apparatus 10, and a potentially-abnormal condition that is different from the normal condition but is short of the abnormal condition.

Setting the potentially-abnormal condition between the normal condition and the abnormal condition makes it possible to predict and inspect a possible error that may occur during a supply operation or a discharge operation. This in turn enables a service person to perform preventive maintenance for the potentially-abnormal condition during a regular inspection in addition to repairing occurred malfunctions.

Thus, the above configuration makes it possible to reduce the occurrence of timeout errors during jobs, reduce time necessary to call a service person and repair the coating-liquid applying apparatus 10, and reduce the downtime of the coating-liquid applying apparatus 10.

Also, performing preventive maintenance on a potentially-abnormal part of the coating-liquid applying apparatus 10 makes it possible to reduce the number of times a service person needs to visit a site for irregular inspections.

Also, the above configuration enables a service person to easily identify spots for which preventive maintenance needs to be performed. This in turn makes it possible to reduce maintenance time and to improve the efficiency of maintenance.

Data (the supply log and the discharge log) stored in the NVRAM 52 is displayed on the operations panel 71 and is thereby presented to the service person during maintenance. Also, the data may be sent from the communicator 14 of the coating-liquid applying apparatus 10 to the communicator 220 of the maintenance terminal 200 carried by the service person, and displayed on the terminal panel 210 of the maintenance terminal 200 during maintenance.

With the above configuration, during a regular inspection, the service person can refer to the supply log and the discharge log to identify spots on which preventive maintenance needs to be performed, and can prevent errors that may occur during supply and discharge operations by performing preventive maintenance on the identified spots. This in turn makes it possible to reduce maintenance time, to reduce the number of times the service person needs to visit a site for irregular inspections, and to improve the efficiency of maintenance.

<Supply Operation>

Figure 6:
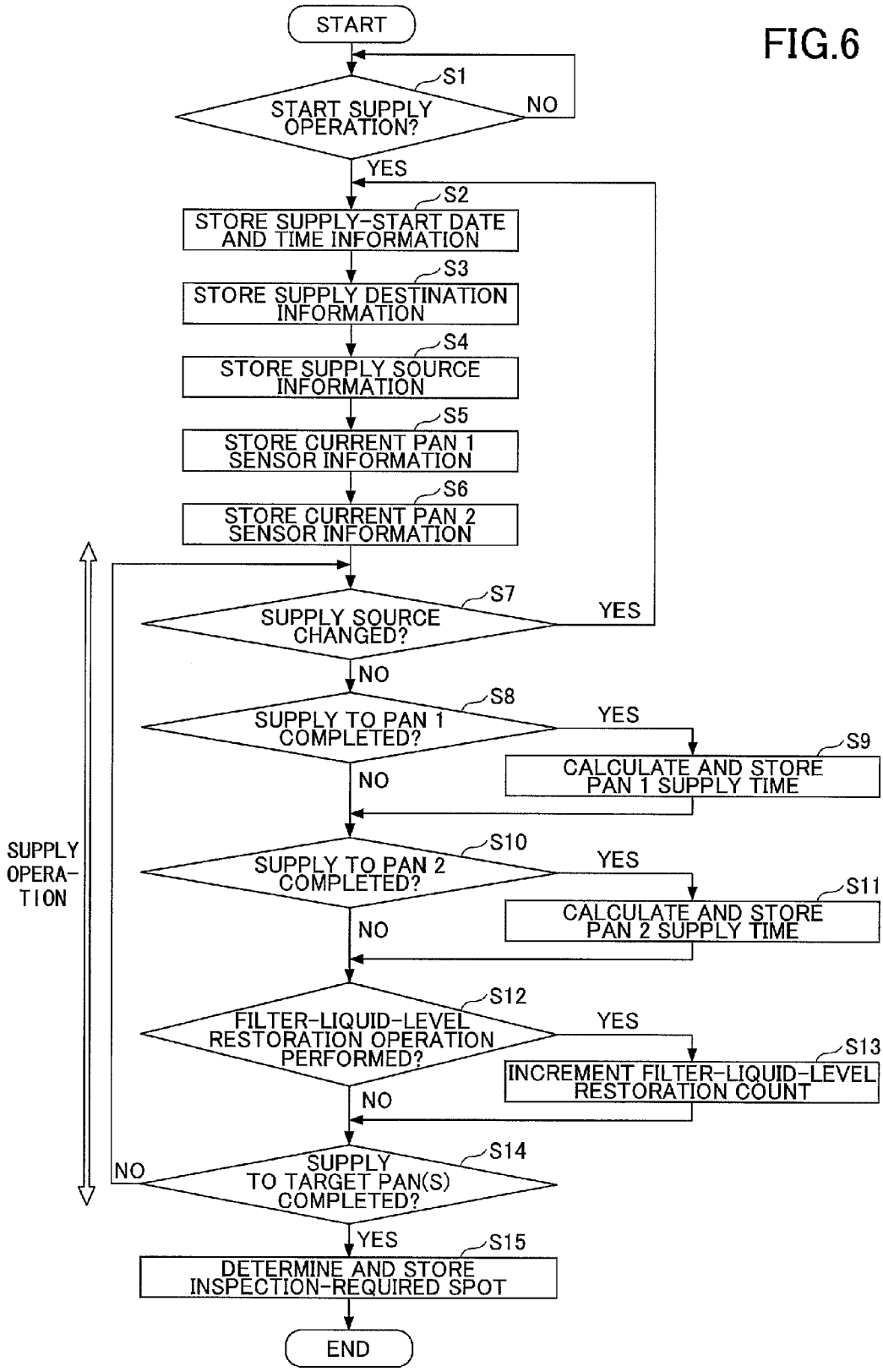
FIG. 6 is a flowchart illustrating an exemplary information storing process performed during a supply operation according to an embodiment of the present invention.

FIG. 6 is a flowchart illustrating an exemplary information storing process performed during a supply operation according to an embodiment of the present invention.

S1: The controller 50 determines whether to perform a supply operation to supply the coating liquid to one or both of the feeding pans 1 and 2. In the present embodiment, the supply operation is performed in response to an instruction when the power supply 15 of the coating-liquid application apparatus 10 is turned on, or when an application operation is to be started after the coating liquid in the feeding pans 1 and 2 is discharged into the reserve tank 4. When it is determined at step S1 to perform the supply operation, the controller 50 proceeds to step S2.

S2: The controller 50 stores, in the NVRAM 52, supply-start date-and-time information indicating when the current supply operation is started. More specifically, based on date-and-time information received from the host controller 110, the controller 50 stores a date value, an hour value, a minute value, and a second value at the start of the supply operation in the first storage 501 of the NVRAM 52.

S3: The controller 50 stores, in the NVRAM 52, supply destination information indicating one or more destinations to which the coating liquid is supplied in the current supply operation.

More specifically, the controller 50 stores, in the second storage 502 of the NVRAM 52, "01" when the coating liquid is supplied to the feeding pan 1, "02" when the coating liquid is supplied to the feeding pan 2, or "03" when the coating liquid is supplied to both of the feeding pans 1 and 2.

S4: The controller 50 stores, in the NVRAM 52, supply source information indicating a source from which the coating liquid is supplied in the current supply operation. More specifically, the controller 50 stores, in the second storage 502 of the NVRAM 52, "01" when the coating liquid is supplied from the cartridge 3, or "02" when the coating liquid is supplied from the reserve tank 4.

S5: The controller 50 stores, in the NVRAM 52, pan 1 sensor information indicating the liquid level in the feeding pan 1 detected by the L-level sensor 40, the M-level sensor 41, and the H-level sensor 42 before the start of the current supply operation.

More specifically, the controller 50 stores, in the third storage 503 of the NVRAM 52, "00" when the coating liquid is detected by none of the L-level sensor 40, the M-level sensor 41, and the H-level sensor 42, "01" when the coating liquid is detected only by the L-level sensor 40, "02" when the coating liquid is detected by the L-level sensor 40 and the M-level sensor 41, or "03" when the coating liquid is detected by all of the L-level sensor 40, the M-level sensor 41, and the H-level sensor 42.

S6: The controller 50 stores, in the NVRAM 52, pan 2 sensor information indicating the liquid level in the feeding pan 2 detected by the L-level sensor 43, the M-level sensor 44, and the H-level sensor 45 before the start of the current supply operation. More specifically, the controller 50 stores, in the third storage 503 of the NVRAM 52, "00" when the coating liquid is detected by none of the L-level sensor 43, the M-level sensor 44, and the H-level sensor 45, "01" when the coating liquid is detected only by the L-level sensor 43, "02" when the coating liquid is detected by the L-level sensor 43 and the M-level sensor 44, or "03" when the coating liquid is detected by all of the L-level sensor 43, the M-level sensor 44, and the H-level sensor 45.

Step S7 and subsequent steps are performed after the supply operation is started.

S7: The controller 50 determines whether the source of the coating liquid is changed. When, for example, the source is changed from the reserve tank 4 to the cartridge 3, the controller 50 returns to step S2 and store information again in the NVRAM 52.

S8: The controller 50 determines whether the coating liquid in the feeding pan 1 has risen to a level that is detectable by the H-level sensor 42. When the coating liquid is detected by the H-level sensor 42 (YES at S8), the controller 50 proceeds to step S9.

S9: The controller 50 calculates a pan 1 supply time (a supply operation time from when the supply operation is started to when the coating liquid in the feeding pan 1 reaches a predetermined liquid level) based on a difference between current date-and-time information and the supply-start date-and-time information stored in the first storage 501 at step S2. The controller 50 stores the calculated pan 1 supply time in the fourth storage 504 of the NVRAM 52.

S10: The controller 50 determines whether the coating liquid in the feeding pan 2 has risen to a level that is detectable by the H-level sensor 45.

When the coating liquid is detected by the H-level sensor 45 (YES at S10), the controller 50 proceeds to step S11.

S11: The controller 50 calculates a pan 2 supply time (a supply operation time from when the supply operation is started to when the coating liquid in the feeding pan 2 reaches a predetermined liquid level) based on a difference between current date-and-time information and the supply-start date-and-time information stored in the first storage 501 at step S2. The controller 50 stores the calculated pan 2 supply time in the fourth storage 504 of the NVRAM 52.

S12: The controller 50 determines whether the low-level restoration operation or the high-level restoration operation has been performed for the filter case 5.

When the source of the coating liquid is the reserve tank 4, the coating liquid in the filter case 5 needs to be at a predetermined level during the supply operation. Otherwise, the flow rates of the coating liquid at an input port and an output port of the filter case 5 vary, and the coating liquid cannot be normally supplied. The low-level restoration operation and the high-level restoration operation are performed for this reason. When it is determined that the low-level restoration operation or the high-level restoration operation has been performed (YES at step S12), the controller 50 proceeds to step S13.

S13: The controller 50 increments the low-level restoration count or the high-level restoration count by 1, and stores the incremented low-level or high-level restoration count in the sixth storage 506 of the NVRAM 52.

S14: The controller 50 determines whether the coating liquid in each of target pans (the feeding pan 1, the feeding pan 2, or both of the feeding pans 1 and 2) has risen to a level detectable by the H-level sensor 42 or 45, i.e., whether the supply operation has been completed.

When it is determined that the supply operation has not been completed (NO at step S14), the controller 50 returns to step S7. When it is determined that the supply operation has been completed (YES at step S14), the controller 50 proceeds to step S15.

S15: The controller 50 determines an inspection-required spot (route No.) based on the pan 1 supply time, the pan 2 supply time, and the filter-liquid-level restoration count. If an inspection-required spot is determined, the controller 50 stores the determined inspection-required spot in the fifth storage 505 of the NVRAM 52.

At step S15, the condition determiner 54 of the controller 50 determines the condition of each route used to supply the coating liquid based on the measured supply operation time and the filter-liquid-level restoration count, as one of a normal condition, an abnormal condition, and a potentially-abnormal condition that is different from the normal condition but is short of the abnormal condition.

When it is determined that the route is in the potentially-abnormal condition, the condition determiner 54 stores the route as the inspection-required spot.

Examples of routes determined as inspection-required spots in the supply operation are described below.

When the source of the coating liquid is the cartridge 3 and the pan 1 supply time (the supply operation time of the feeding pan 1) is higher than or equal to 1.2 times of the normal supply operation time and less than 1.5 times of the normal supply operation time, the front-side unused-liquid supply route α (line "g"+line "a") is determined as an inspection-required spot.

When the source of the coating liquid is the cartridge 3 and the pan 2 supply time (the supply operation time of the feeding pan 2) is higher than or equal to 1.2 times of the normal supply operation time and less than 1.5 times of the normal supply operation time, the back-side unused-liquid supply route β (line "g"+line "b") is determined as an inspection-required spot.

When the source of the coating liquid is the reserve tank 4, the pan 1 supply time is higher than or equal to 1.2 times of the normal supply operation time and less than 1.5 times of the normal supply operation time, and the pan 2 supply time is within the normal supply operation time, the front-side circulated-liquid supply route γ (line "e"+line "f"+line "a") is determined as an inspection-required spot.

When the source of the coating liquid is the reserve tank 4, the pan 2 supply time is higher than or equal to 1.2 times of the normal supply operation time and less than 1.5 times of the normal supply operation time, and the pan 1 supply time is within the normal supply operation time, the back-side circulated-liquid supply route δ (line "e"+line "f"+line "b") is determined as an inspection-required spot.

When the source of the coating liquid is the reserve tank 4 and both of the pan 1 supply time and the pan 2 supply time are higher than or equal to 1.2 times of the normal supply operation time and less than 1.5 times of the normal supply operation time, the line "e" and the line "f" are determined as inspection-required spots.

When the low-level restoration count of the filter case 5 is higher than or equal to a predetermined value T5, the line "e" is determined as an inspection-required spot.

When the high-level restoration count of the filter case 5 is higher than or equal to a predetermined value T6, the leak "i" of the filter case 5 is determined as an inspection-required spot.

Serial numbers may be assigned to the above-described inspection-required spots, and stored in the NVRAM 52.

Setting the potentially-abnormal condition between the normal condition and the abnormal condition as described above makes it possible to predict and inspect a possible error during a regular inspection. This in turn enables a service person to perform preventive maintenance for the potentially-abnormal condition in addition to repairing occurred malfunctions.

Thus, the above configuration makes it possible to reduce timeout errors that occur during a supply operation due to a failure of the coating-liquid applying apparatus 10 (or the coating-liquid supplying apparatus 20). This in turn makes it possible to reduce time necessary to call a service person and repair the coating-liquid applying apparatus 10, and reduce the downtime of the coating-liquid applying apparatus 10.

<Discharge Operation>

Figure 7:
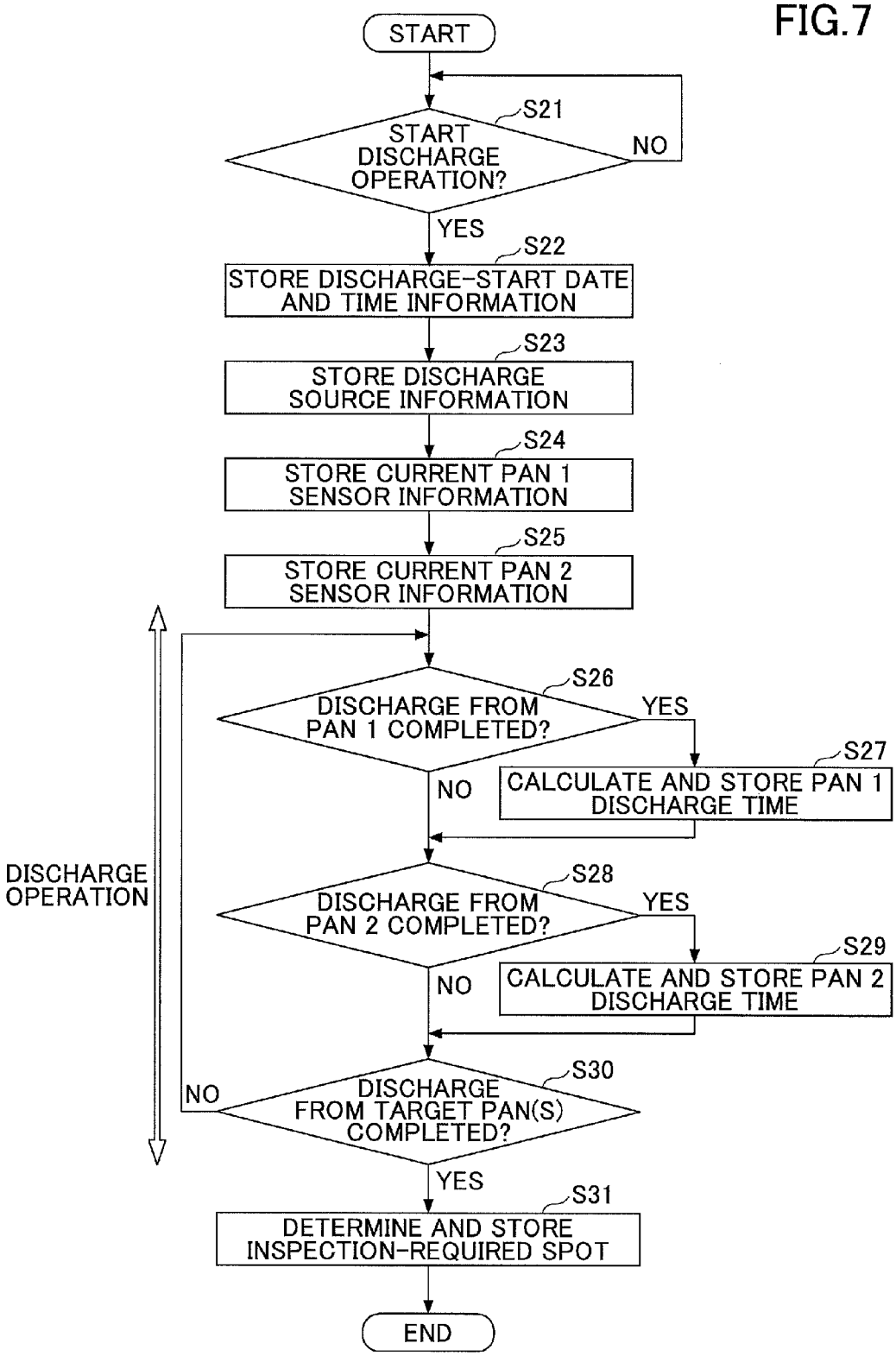
FIG. 7 is a flowchart illustrating an exemplary information storing process performed during a discharge operation according to an embodiment of the present invention.

FIG. 7 is a flowchart illustrating an exemplary information storing process performed during a discharge operation according to an embodiment of the present invention.

S21: The controller 50 determines whether to perform a discharge operation to discharge the coating liquid from one or both of the feeding pans 1 and 2. When it is determined to perform the discharge operation (YES at step S21), the controller 50 proceeds to step S22.

S22: The controller 50 stores, in the NVRAM 52, discharge-start date-and-time information indicating when the current discharge operation is started. More specifically, based on date-and-time information received from the host controller 110, the controller 50 stores a date value, an hour value, a minute value, and a second value at the start of the discharge operation in the seventh storage 507 of the NVRAM 52.

S23: The controller 50 stores, in the NVRAM 52, discharge source information indicating one or more sources from which the coating liquid is discharged in the current discharge operation. More specifically, the controller 50 stores, in the eighth storage 508 of the NVRAM 52, "01" when the coating liquid is discharged from the feeding pan 1, "02" when the coating liquid is discharged from the feeding pan 2, or "03" when the coating liquid is discharged from both of the feeding pans 1 and 2.

S24: The controller 50 stores, in the NVRAM 52, pan 1 sensor information indicating the liquid level in the feeding pan 1 detected by the L-level sensor 40, the M-level sensor 41, and the H-level sensor 42 before the start of the current discharge operation.

More specifically, the controller 50 stores, in the ninth storage 509 of the NVRAM 52, "00" when the coating liquid is detected by none of the L-level sensor 40, the M-level sensor 41, and the H-level sensor 42, "01" when the coating liquid is detected only by the L-level sensor 40, "02" when the coating liquid is detected by the L-level sensor 40 and the M-level sensor 41, or "03" when the coating liquid is detected by all of the L-level sensor 40, the M-level sensor 41, and the H-level sensor 42.

S25: The controller 50 stores, in the NVRAM 52, pan 2 sensor information indicating the liquid level in the feeding pan 2 detected by the L-level sensor 43, the M-level sensor 44, and the H-level sensor 45 before the start of the current discharge operation.

More specifically, the controller 50 stores, in the ninth storage 509 of the NVRAM 52, "00" when the coating liquid is detected by none of the L-level sensor 43, the M-level sensor 44, and the H-level sensor 45, "01" when the coating liquid is detected only by the L-level sensor 43, "02" when the coating liquid is detected by the L-level sensor 43 and the M-level sensor 44, or "03" when the coating liquid is detected by all of the L-level sensor 43, the M-level sensor 44, and the H-level sensor 45.

S26: The controller 50 determines whether the coating liquid in the feeding pan 1 has fallen to a level that is undetectable by the L-level sensor 40. When the coating liquid is undetectable by the L-level sensor 40, the controller 50 determines that the discharge of the coating liquid from the feeding pan 1 is completed (YES at S26) and proceeds to step S27.

S27: The controller 50 calculates a pan 1 discharge time (a discharge operation time from when the discharge operation is started to when the coating liquid in the feeding pan 1 falls to a predetermined liquid level) based on a difference between current date-and-time information and the discharge-start date-and-time information stored in the seventh storage 507 at step S22. The controller 50 stores the calculated pan 1 discharge time in the tenth storage 510 of the NVRAM 52.

S28: The controller 50 determines whether the coating liquid in the feeding pan 2 has fallen to a level that is undetectable by the L-level sensor 43. When the coating liquid is undetectable by the L-level sensor 43, the controller 50 determines that the discharge of the coating liquid from the feeding pan 2 is completed (YES at S28) and proceeds to step S29.

S29: The controller 50 calculates a pan 2 discharge time (a discharge operation time from when the discharge operation is started to when the coating liquid in the feeding pan 2 falls to a predetermined liquid level) based on a difference between current date-and-time information and the discharge-start date-and-time information stored in the seventh storage 507 at step S22. The controller 50 stores the calculated pan 2 discharge time in the tenth storage 510 of the NVRAM 52.

S30: The controller 50 determines whether the coating liquid in each of target pans (the feeding pan 1, the feeding pan 2, or both of the feeding pans 1 and 2) has fallen to a level undetectable by the L-level sensor 40 or 43, i.e., whether the discharge operation has been completed. When it is determined that the discharge operation has not been completed (NO at step S30), the controller 50 returns to step S26. When it is determined that the discharge operation has been completed (YES at step S30), the controller 50 proceeds to step S31.

S31: The controller 50 determines an inspection-required spot (route No.) based on the pan 1 discharge time and the pan 2 discharge time. If an inspection-required spot is determined, the controller 50 stores the determined inspection-required spot in the eleventh storage 511 of the NVRAM 52.

At step S31, the condition determiner (discharge condition determiner) 54 of the controller 50 determines the condition of each route used to discharge the coating liquid based on the measured discharge operation time, as one of a normal condition, an abnormal condition, and a potentially-abnormal condition that is different from the normal condition but is short of the abnormal condition.

When it is determined that the route is in the potentially-abnormal condition, the condition determiner 54 stores the route as the inspection-required spot.

Examples of routes determined as inspection-required spots in the discharge operation are described below.

When the pan 1 discharge time (the discharge operation time of the feeding pan 1) is higher than or equal to 1.2 times of the normal discharge operation time and less than 1.5 times of the normal discharge operation time, the front-side discharge route $\epsilon$ (line "c"+line "h") is determined as an inspection-required spot.

When the pan 2 discharge time (the discharge operation time of the feeding pan 2) is higher than or equal to 1.2 times of the normal discharge operation time and less than 1.5 times of the normal discharge operation time, the back-side discharge route $\zeta$ (line "d"+line "h") is determined as an inspection-required spot.

Serial numbers may be assigned to the above-described inspection-required spots, and stored in the NVRAM 52.

Setting the potentially-abnormal condition between the normal condition and the abnormal condition as described above makes it possible to predict and inspect a possible error during a regular inspection. This in turn enables a service person to perform preventive maintenance for the potentially-abnormal condition in addition to repairing occurred malfunctions.

Thus, the above configuration makes it possible to reduce timeout errors that occur during a discharge operation due to a failure of the coating-liquid applying apparatus 10 (or the coating-liquid supplying apparatus 20). This in turn makes it possible to reduce time necessary to call a service person and repair the coating-liquid applying apparatus 10, and reduce the downtime of the coating-liquid applying apparatus 10.

An aspect of the present disclosure provides a liquid applying apparatus and a method of maintaining the liquid applying apparatus that make it possible to predict and inspect a possible error that may occur during a supply operation or a discharge operation of a feeding pan, and to reduce downtime of the liquid applying apparatus.

A liquid applying apparatus and a method for maintaining the liquid applying apparatus according to embodiments of the present invention are described above. However, the present invention is not limited to the specifically disclosed embodiments, and variations and modifications may be made without departing from the scope of the present invention.

What is claimed is:

1. A liquid applying apparatus comprising:

at least one application unit including a feeding container configured to contain a liquid, the application unit being configured to apply the liquid to an object;

a first liquid-supply container configured to supply the liquid to the feeding container;

a second liquid-supply container configured to supply the liquid to the feeding container;

a switch configured to switch a supply source of the liquid between the first liquid-supply container and the second liquid-supply container;

a first storage configured to store a supply start time when a supply operation to supply the liquid to the feeding container is started, the supply operation being performed to fill the feeding container with the liquid up to a predetermined supply level;

a second storage configured to store supply information including one of supply source information indicating the supply source of the liquid and supply route information indicating a supply route through which the liquid is supplied;

a third storage configured to store a liquid level of the liquid in the feeding container at a start of the supply operation;

a fourth storage configured to store a supply operation time from the start of the supply operation until the liquid in the feeding container reaches the predetermined supply level;

a controller configured to determine, after the supply operation is completed, a condition of the liquid applying apparatus based on the supply operation time stored in the fourth storage as one of a normal condition, an abnormal condition requiring a repair, and a potentially-abnormal condition that is different from both of the normal condition and the abnormal condition, and determine the supply source or the supply route as an inspection-required spot based on the supply information stored in the second storage when the liquid applying apparatus is determined to be in the potentially-abnormal condition; and a fifth storage configured to store the inspection-required spot determined by the controller.

2. The liquid applying apparatus according to claim 1, further comprising:

a filter container including a filter configured to filter a circulated liquid that has passed through the feeding container, wherein the first liquid-supply container contains an unused liquid;

the second liquid-supply container contains the circulated liquid;

the supply route includes an unused-liquid supply route including an outgoing line for sending the unused liquid from the first liquid-supply container to the switch and a supply line coupling the switch to the feeding container, and a circulated-liquid supply route including a circulation line through which the circulated liquid flows from the second liquid container via the filter container to the switch and the supply line; and the supply line is configured to carry the unused liquid when the first liquid-supply container is the supply source and to carry the circulated liquid filtered by the filter of the filter container when the second liquid-supply container is the supply source.

3. The liquid applying apparatus according to claim 2, wherein the at least one application unit includes a front-side application unit including a front-side feeding container and configured to apply the liquid to a front side of the object, and a back-side application unit including a back-side feeding container and configured to apply the liquid to a back side of the object; and the liquid applying apparatus further comprises:

a front-side liquid-level detector configured to detect a liquid level of the liquid in the front-side feeding container, and a back-side liquid-level detector configured to detect a liquid level of the liquid in the back-side feeding container.

4. The liquid applying apparatus according to claim 3, wherein the unused-liquid supply route includes a front-side unused-liquid supply route including the outgoing line and a front-side supply line coupling the switch to the front-side feeding container, and a back-side unused-liquid supply route including the outgoing line and a back-side supply line coupling the switch to the back-side feeding container;

the circulated-liquid supply route includes a front-side circulated-liquid supply route including the circulation line and the front-side supply line, and a back-side circulated-liquid supply route including the circulation line and the back-side supply line;

the second storage is configured to store the supply information that includes either the supply source information indicating the supply source and supply destination information indicating supply destinations that are the front-side feeding container and the back-side feeding container to which the liquid is supplied, or the supply route information indicating one of the front-side unused-liquid supply route, the back-side unused-liquid supply route, the front-side circulated-liquid supply route, and the back-side circulated-liquid supply route for each combination of the supply source and the supply destinations;

the third storage is configured to store the liquid level in the front-side feeding container and the liquid level in the back-side feeding container that are detected by the front-side liquid-level detector and the back-side liquid-level detector at the start of the supply operation; and the fourth storage is configured to store the supply operation time for each of the front-side feeding container and the back-side feeding container.

5. The liquid applying apparatus according to claim 4, wherein the controller is configured to perform, during the supply operation, a high-level restoration operation and a low-level restoration operation to maintain a liquid level in the filter container at a constant level, the high-level restoration operation being performed to decrease the liquid level in the filter container, the low-level restoration operation being performed to increase the liquid level in the filter container;

the liquid applying apparatus further comprises a sixth storage configured to store a high-level restoration count indicating a number of times the high-level restoration operation is performed and a low-level restoration count indicating a number of times the low-level restoration operation is performed; and the controller is configured to determine the condition of the liquid applying apparatus after the supply operation is completed based on the supply operation time stored in the fourth storage and the high-level restoration count and the low-level restoration count stored in the sixth storage.

6. The liquid applying apparatus according to claim 3, further comprising:

a recovery container configured to contain the liquid discharged via discharge routes from the front-side feeding container and the back-side feeding container, wherein the discharge routes include a front-side discharge route including a front-side escape line for discharging the liquid from the front-side feeding container into the second liquid-supply container and a recovery line for discharging the liquid from the second liquid-supply container into the recovery container, and a back-side discharge route including a back-side escape line for discharging the liquid from the back-side feeding container into the second liquid-supply container and the recovery line;

the liquid applying apparatus further comprises:

a seventh storage configured to store a discharge start time when a discharge operation is started, the discharge operation being performed to discharge the liquid from the front-side feeding container and the back-side feeding container until the liquid decreases to a predetermined discharge level, an eighth storage configured to store discharge information including one of discharge source information indicating the front-side feeding container and the back-side feeding container and discharge route information indicating the front-side discharge route and the back-side discharge route, a ninth storage configured to store a liquid level of the liquid in each of the front-side feeding container and the back-side feeding container at a start of the discharge operation, a tenth storage configured to store a discharge operation time from the start of the discharge operation until the liquid decreases to the predetermined discharge level for each of the front-side feeding container and the back-side feeding container, and an eleventh storage;

after the discharge operation is completed, the controller is configured to determine the condition of the liquid applying apparatus based on the discharge operation time stored in the tenth storage as one of the normal condition, the abnormal condition, and the potentially-abnormal condition, and determine one of the front-side discharge route and the back-side discharge route as an inspection-required spot when the liquid applying apparatus is determined to be in the potentially-abnormal condition; and the eleventh storage is configured to store the one of the front-side discharge route and the back-side discharge route determined by the controller as the inspection required spot.

7. The liquid applying apparatus according to claim 6, wherein the controller is configured to determine that the liquid applying apparatus is in the abnormal condition when the discharge operation time is higher than or equal to 1.5 times of a normal discharge operation time; and determine that the liquid applying apparatus is in the potentially-abnormal condition when the discharge operation time is higher than or equal to 1.2 times of the normal discharge operation time and less than 1.5 times of the normal discharge operation time.

8. The liquid applying apparatus according to claim 6, wherein the liquid applying apparatus is configured to be regularly inspected;

the controller is configured to report a timeout error to request a service person to perform an irregular inspection when the liquid applying apparatus is in the abnormal condition; and at a current inspection by the service person, the controller is configured to report, to the service person, information stored in the storages for discharge operations performed between a previous inspection and the current inspection.

9. The liquid applying apparatus according to claim 1, wherein the controller is configured to determine that the liquid applying apparatus is in the abnormal condition when the supply operation time is higher than or equal to 1.5 times of a normal supply operation time; and determine that the liquid applying apparatus is in the potentially-abnormal condition when the supply operation time is higher than or equal to 1.2 times of the normal supply operation time and less than 1.5 times of the normal supply operation time.

10. The liquid applying apparatus according to claim 1, wherein the liquid applying apparatus is configured to be regularly inspected;

the controller is configured to report a timeout error to request a service person to perform an irregular inspection when the liquid applying apparatus is in the abnormal condition; and at a current inspection by the service person, the controller is configured to report, to the service person, information stored in the storages for supply operations performed between a previous inspection and the current inspection.

11. The liquid applying apparatus according to claim 1, further comprising:

a flow generator configured to cause the liquid to flow; and a plurality of opening-closing devices configured to open and close the outgoing line, the supply line, and the circulation line.

12. A method for maintaining a liquid applying apparatus, the method comprising:

performing a supply operation to supply a liquid from one of a first liquid-supply container and a second liquid-supply container to a feeding container of an application unit of the liquid applying apparatus for applying the liquid to an object, the supply operation being performed to fill the feeding container with the liquid up to a predetermined supply level;

controlling a switch to switch a supply source of the liquid between the first liquid-supply container and the second liquid-supply container;

storing, in a first storage of the liquid applying apparatus, a supply start time when the supply operation is started;

storing, in a second storage of the liquid applying apparatus, supply information including one of supply source information indicating the supply source of the liquid and supply route information indicating a supply route through which the liquid is supplied;

storing, in a third storage of the liquid applying apparatus, a liquid level of the liquid in the feeding container at a start of the supply operation;

storing, in a fourth storage of the liquid applying apparatus, a supply operation time from the start of the supply operation until the liquid in the feeding container reaches the predetermined supply level;

after the supply operation is completed, determining a condition of the liquid applying apparatus based on the supply operation time stored in the fourth storage as one of a normal condition, an abnormal condition requiring a repair, and a potentially-abnormal condition that is different from both of the normal condition and the abnormal condition;

when the liquid applying apparatus is determined to be in the potentially-abnormal condition, determining the supply source or the supply route as an inspection-required spot based on the supply information stored in the second storage; and storing, in a fifth storage of the liquid applying apparatus, the determined inspection-required spot.

* * * * *